US007637470B2

(12) United States Patent
Siu

(10) Patent No.: US 7,637,470 B2
(45) Date of Patent: Dec. 29, 2009

(54) MOUNTING MECHANISM FOR REMOVABLE BOLLARD

(75) Inventor: Kin Wai Michael Siu, Hong Kong (CN)

(73) Assignee: The Hong Kong Polytechnic University, Kowloon (HK)

( * ) Notice: Subject to any disclaimer, the term of this patent is extended or adjusted under 35 U.S.C. 154(b) by 238 days.

(21) Appl. No.: 11/806,690

(22) Filed: Jun. 4, 2007

(65) Prior Publication Data

US 2008/0296462 A1 Dec. 4, 2008

(51) Int. Cl.
*F16M 13/00* (2006.01)

(52) U.S. Cl. ..... 248/519; 248/346.01

(58) Field of Classification Search ..... 248/519, 248/523, 511, 346.01, 346.03; 135/16; 52/296, 52/297, 40

See application file for complete search history.

(56) References Cited

U.S. PATENT DOCUMENTS

| | | | | |
|---|---|---|---|---|
| 3,119,588 | A * | 1/1964 | Keats | 248/158 |
| 3,784,136 | A * | 1/1974 | Lopez | 47/40.5 |
| 4,922,673 | A * | 5/1990 | Ishii et al. | 52/220.1 |
| 5,121,579 | A * | 6/1992 | Hamar et al. | 52/582.1 |
| 5,568,909 | A * | 10/1996 | Timko | 248/519 |
| 6,889,953 | B2 * | 5/2005 | Harbaugh | 248/519 |
| 2004/0011941 | A1 * | 1/2004 | Roepke et al. | 248/519 |
| 2004/0069922 | A1 * | 4/2004 | Wu | 248/519 |
| 2004/0195487 | A1 * | 10/2004 | Harbaugh | 248/519 |
| 2008/0224016 | A1 * | 9/2008 | Defu et al. | 248/523 |

* cited by examiner

*Primary Examiner*—A. Joseph Wujciak, III

(57) ABSTRACT

The present invention provides a mounting mechanism for a removable bollard, which has high flexibility and convenience for the removal and reinstallation of the bollard and the socket for inserting the bollard can be covered without having additional devices after the removal of the bollard.

8 Claims, 10 Drawing Sheets

MOUNTING MECHANISM FOR REMOVABLE BOLLARD

FIELD OF THE INVENTION

The present invention relates to a removable bollard, more particularly, relates to a mounting mechanism for removable bollard.

BACKGROUND OF THE INVENTION

Bollards (also known as poles, posts, columns, or pilars), particularly traffic bollards come in a variety of shapes and size. Some are permanently erected in the road, others are temporarily put out into the ground for example when road works in progress. The bollard for temporary use should be removable so that it can be easily removed when unnecessary.

There are many removable bollards in use. However, the known bollards suffer from a number of defects. Nearly all of them require an additional device (for example, mounting mechanism) to hold and secure a bollard in place. Moreover, after the bollard removed, a hole generally remains in the ground. In order to prevent accidents, an additional device, for example, a cap/cover is generally required to cover the hole. The handling and storage of such additional devices are inconvenient. In addition, sometimes a cap/cover of the bollard hole is not removed when the bollard is installed in the ground. For example, some caps flip up when the bollards are installed. However such devices/caps can easily injure pedestrians or cause inconvenience for circulation.

There is therefore a need for a mounting mechanism for removable bollard which overcomes the above defects of the known bollard.

SUMMARY OF THE INVENTION

An object of the present invention is to provide a mounting mechanism for removable bollard, which has high flexibility and convenience for the removal and reinstallation of the bollard and the socket for inserting the bollard can be covered without having additional devices after the removal of the bollard.

In one respect, a mounting mechanism for removable bollard comprises: a body including a receiving part in which a socket is formed for receiving a bollard therein; a carrying part provided above the receiving part, wherein a first through hole is formed therein to correspond to the socket; and a coupling part connecting the carrying part with the receiving part; and at least two cover plates covering the carrying part and provided with notches corresponding to the socket, wherein the notches are arranged such that the notches constitute a second through hole corresponding to the socket when the cover plates match together with the notches assembled together, and the notches are closed by the carrying part when the cover plates match together with notches separated from each other.

In another aspect, a ring is arranged around the bollard at height thereof corresponding to the depth of the socket.

In another aspect, the carrying part is comprised of supporting plates for supporting the cover plates and closures for closing the notches underneath, number and shape of the closures correspond to those of the notches.

In another aspect, the notches are step-shaped; and the cover plate are respectively formed with recesses at the lower surfaces of a sides thereof opposite to a side thereof on which the notches are formed; and the shapes of the closures corresponding to those of the lower part of the step-shaped notches and the recesses.

In another aspect, the carrying part is provided with first fixing holes and the cover plates are provided with second fixing holes at positions corresponding to the second fixing holes.

In another aspect, the coupling part is in box form with top opened, and the socket is formed in the center of the coupling part; the distance from the position where the carrying part is perpendicularly arranged on the inner surface of side walls of the coupling part to the top of the coupling part is smaller than the distance from the top of the receiving part to the top of the coupling part and is equal to the thickness of the cover plates.

In another aspect, the receiving part is provided with a socket base at a lower end thereof for closing the socket.

In another aspect, a plurality of draining holes are respectively formed in the coupling part and the socket base.

The invention provides high flexibility and convenience for the removal and reinstallation of the bollard. During the bollard is installed in the socket, the cover plates are not necessary to be removed away and stored separately. Furthermore, the socket for inserting the bollard can be covered without having additional devices after the removal of the bollard.

The invention fits the current commonly used bollards (for example, bollards with circular or square cross-sectional shape). The invention also can be widely applied to a variety of removable bollards with slightly modifying the invention in the shape of the socket, the shape of the notch of each cover plate and the shape of the closure.

BRIEF DESCRIPTION OF DRAWINGS

The invention will be described for illustrative but not limitative purpose according to its preferred embodiment with particular reference to the enclosed drawings, wherein.

DETAILED DESCRIPTION OF THE PREFERRED EMBODIMENTS

Figure 1A:
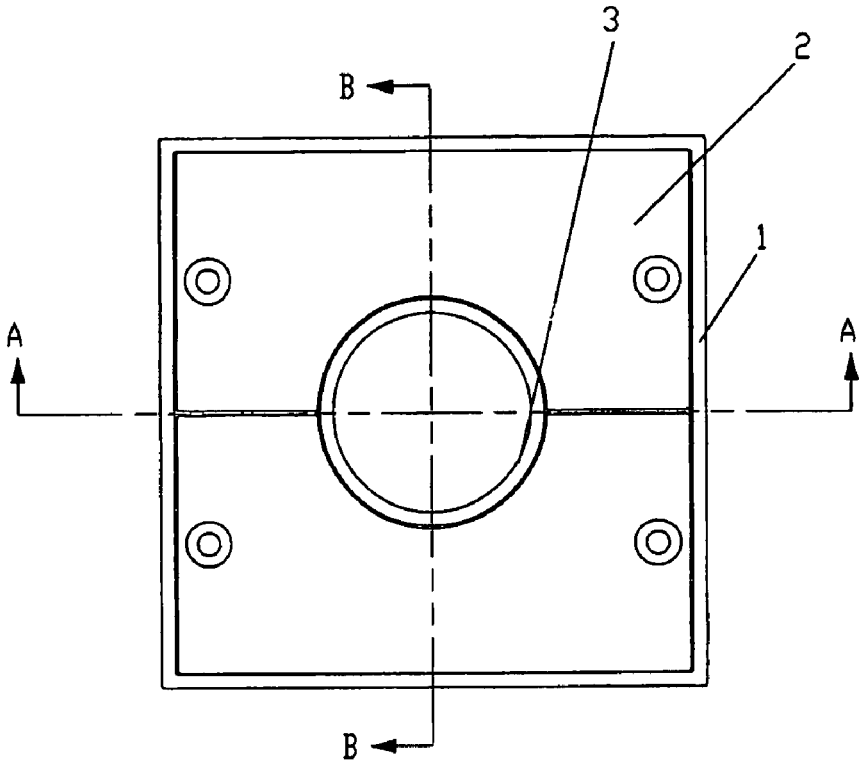
FIG. 1A shows a top view of the mounting mechanism for removable bollard according to the invention, with a bollard mounted therein.
Figure 1B:
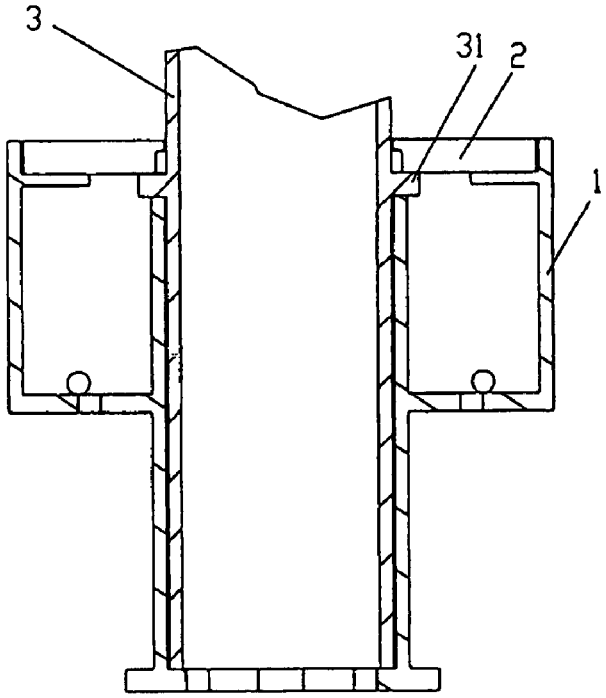
FIG. 1B shows a sectional view of the mounting mechanism for removable bollard in FIG. 1A taken along line A-A.
Figure 1C:
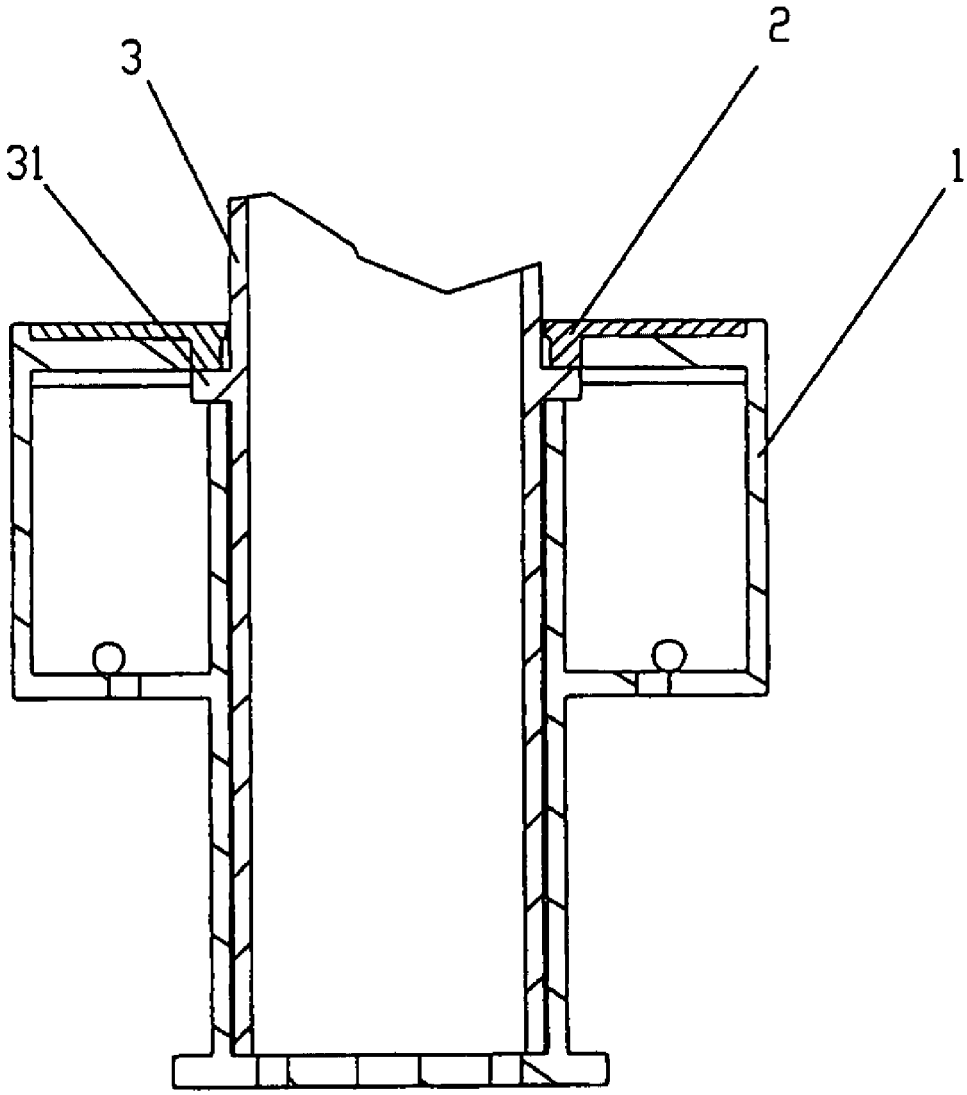
FIG. 1C shows a sectional view of the mounting mechanism for removable bollard in FIG. 1A taken along line B-B.

Refer now to the drawings. As shown in FIGS. 1A to 1C, a mounting mechanism for removable bollard comprises a body 1, and two cover plates 2. A removable bollard 3 is mounted in the mounting mechanism. The body 1 is in box form with top opened, on which the cover plates matching with each other are mounted. The bollard 3 is a hollow cylinder which passes through the cover plates 2 and then inserted in the body 1. The bollard can be a solid cylinder and it does not affect the performance and quality of the mounting mechanism.

Figure 2A:
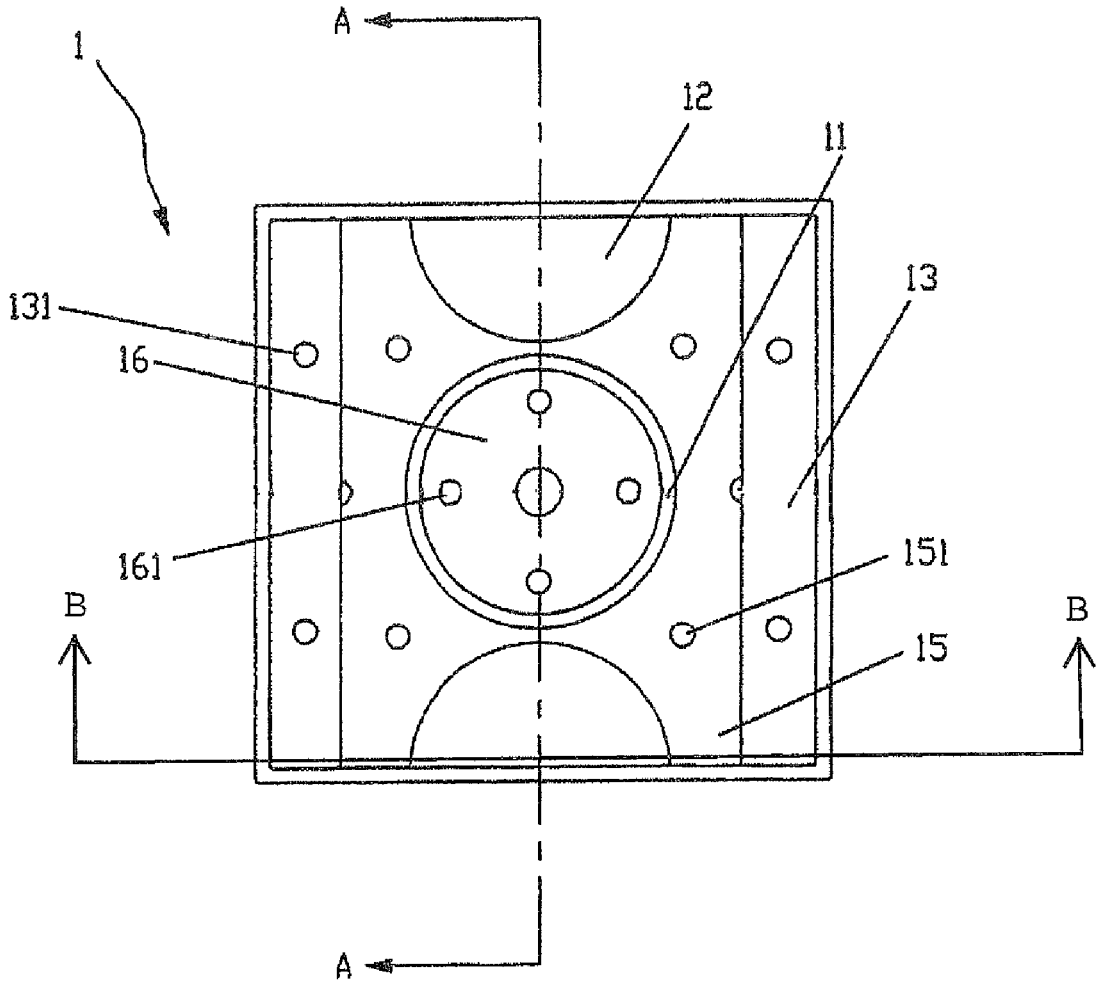
FIG. 2A shows a top view of the body of the mounting mechanism for removable bollard according to the invention.
Figure 2B:
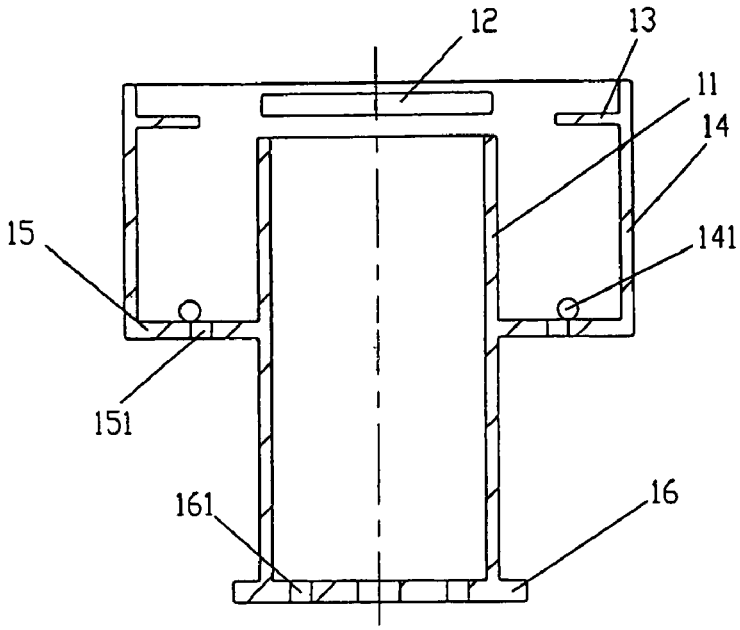
FIG. 2B shows a sectional view of the body in FIG. 2A taken along line B-B.
Figure 2C:
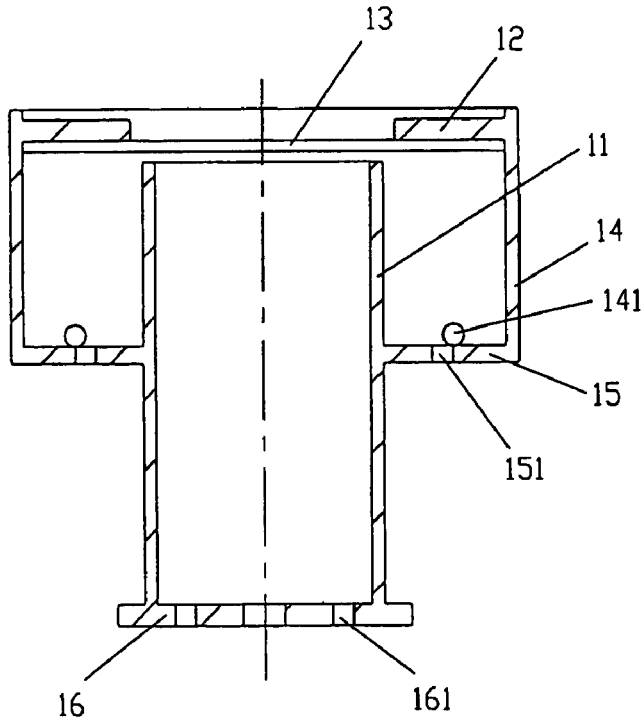
FIG. 2C shows a sectional view of the body in FIG. 2A taken along line A-A.
Figure 3A:
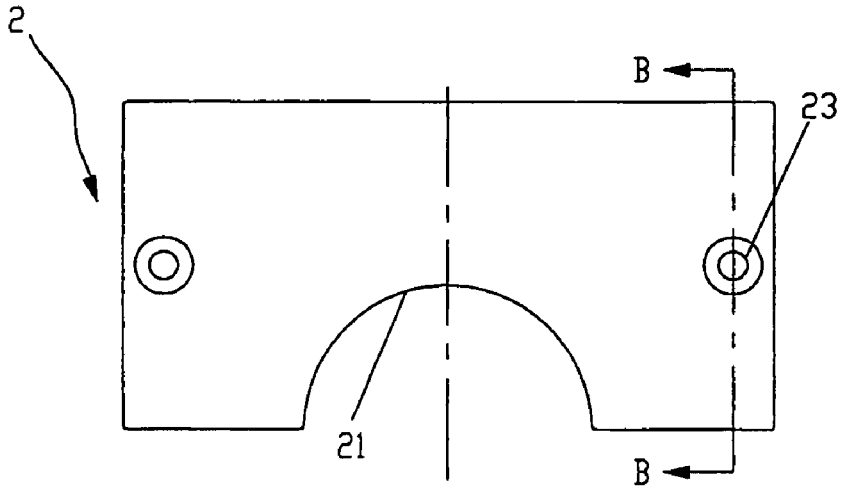
FIG. 3A shows a top view of the cover plate of the mounting mechanism for removable bollard according to the invention.
Figure 3B:
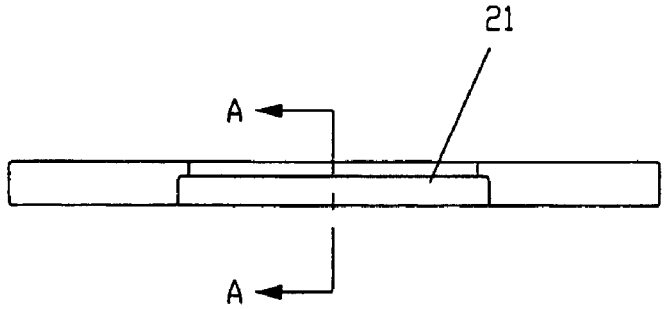
FIG. 3B shows a front view of the cover plate in FIG. 3A.
Figure 3C:
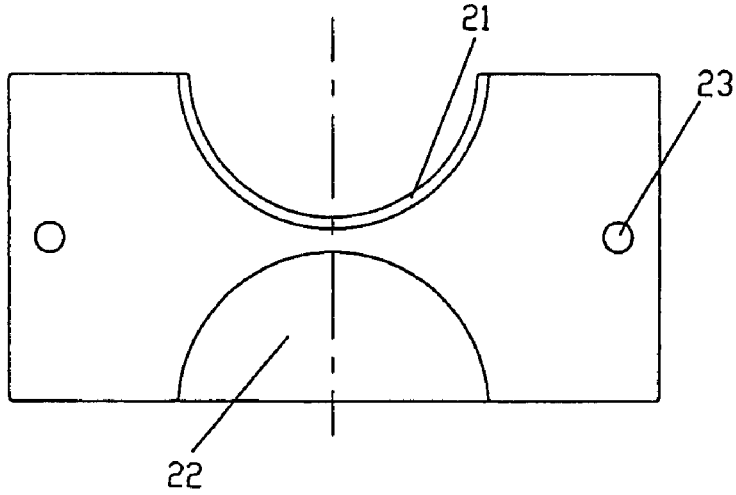
FIG. 3C shows a bottom view of the cover plate in FIG. 3A.
Figure 3D:
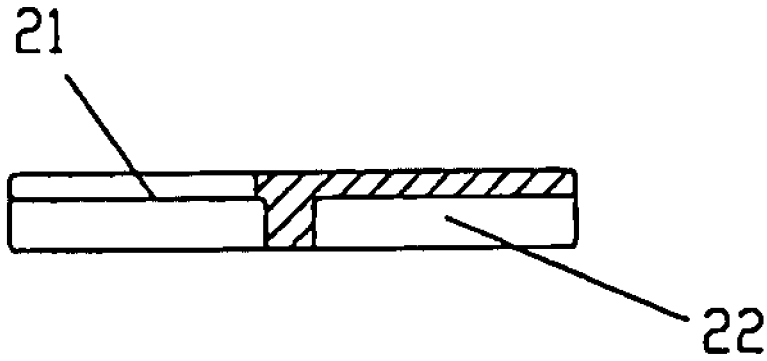
FIG. 3D shows a sectional view of the cover plate in FIG. 3B taken along line A-A.
Figure 3E:
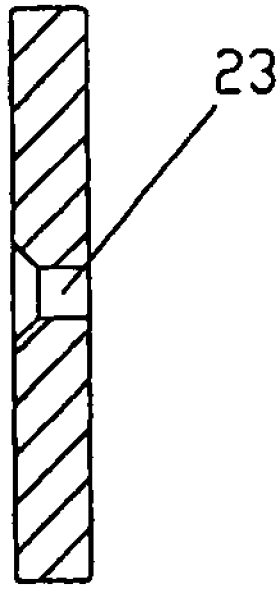
FIG. 3E shows a sectional view of the cover plate in FIG. 3A taken along line B-B.

Refer now to FIGS. 2A to 2C. FIGS. 2A to 2C show the body of the mounting mechanism for removable bollard according to the invention. As shown in FIG. 2A to 2C, the body 1 of the mounting mechanism for removable bollard comprises a receiving part 11 in which a socket is formed to receive the bollard therein, a carrying part provided above the receiving part 11, and a coupling part connecting the carrying part with the receiving part 11, wherein the carrying part is composed of two closures 12 and two supporting plates 13, and the coupling part is composed of four side walls 14 and a body base 15. Specifically, the four vertical side walls 14 are vertically disposed and the body base 15 is planar plate so that the coupling part is in a rectangular box form with the top opened. The two closures 12 are two semicircular tongues perpendicularly arranged on the inner surfaces of two opposite side walls 14, the upper surfaces of which are lower than the top end of the side walls 14. The supporting plates 13 are two rectangular shoulder plates perpendicularly arranged on the inner surfaces of another two opposite side walls 14, the upper surfaces of which are in the same plane as the lower surfaces of the closures 12 so that the supporting plates 13 of the carrying part can support the cover plates 2. A first through hole for allowing the bollard 3 to pass through is formed among the closures 12 and supporting plates 13 to correspond to the socket of the receiving part 11.

The receiving part 11 is a cylinder located in the centre of the body base 15 in order to form the socket to perfectly receive the bollard 3. Preferably the receiving part 11 further comprises a planar socket base 16 for closing the lower end of the socket. The top of the receiving part 11 is as high as or slightly lower than the lower surfaces of the supporting plates 13. That is, the distance from the position where the carrying part is perpendicularly arranged on the inner surface of the side walls 14 of the coupling part to the top of the coupling part is smaller than the distance from the top of the receiving part 11 to the top of the coupling part and is equal to the thickness of the cover plates 2. The lower end of the receiving part 11 sufficiently projects downwards from the bottom of the coupling part so that the socket has sufficient length to securely receive the bollard 3.

Several first fixing holes 131 are formed in the supporting plates 13. Preferably the fixing holes are threaded holes if screws are used to fix the cover plates 2 to the supporting plates 13. In order to help the box-shaped body 1 drain water out, several draining holes 141, 151 and 161 are respectively formed in the side walls 14, the body base 15 and the socket base 16.

Refer now to FIGS. 3A to 3E. FIGS. 3A to 3E show the cover plate of the mounting mechanism for removable bollard according to the invention. As shown in FIG. 3A to 3E, cover plates 2 of the mounting mechanism for removable bollard are two identical rectangular plates. The cover plates 2 for covering the carrying part are respectively provided with notches 21 corresponding to the socket, wherein the notches 21 are arranged such that the notches 21 constitute a second through hole corresponding to the socket when the cover plates 2 match together with the notches 21 assembled together, and the notches 21 are closed underneath by the closures 12 of the carrying part when the cover plates match together with notches separated from each other. Specifically, for the cylinder-shaped bollard, the notch 21 is semicircular and formed in the centre of one longer side of the cover plate 2 and a recess 22 is also semicircular and formed in the lower surface of the other longer side of the cover plate 2. The notch 21 is in step form, and the lower part of the step form can be perfectly fitted to the closure 12. The number and the shape of the closures 12 correspond to those of the notches 21. The recess 22 can be perfectly fitted to the closure 12 too. Besides, two second fixing holes 23 are formed in the edge of the two shorter sides of the cover plate 2, which are countersunk holes. The positions of the second fixing holes 23 correspond to that of the first fixing holes 131 such that they can be fixed together by screws/bolts and nuts.

Figure 4A:
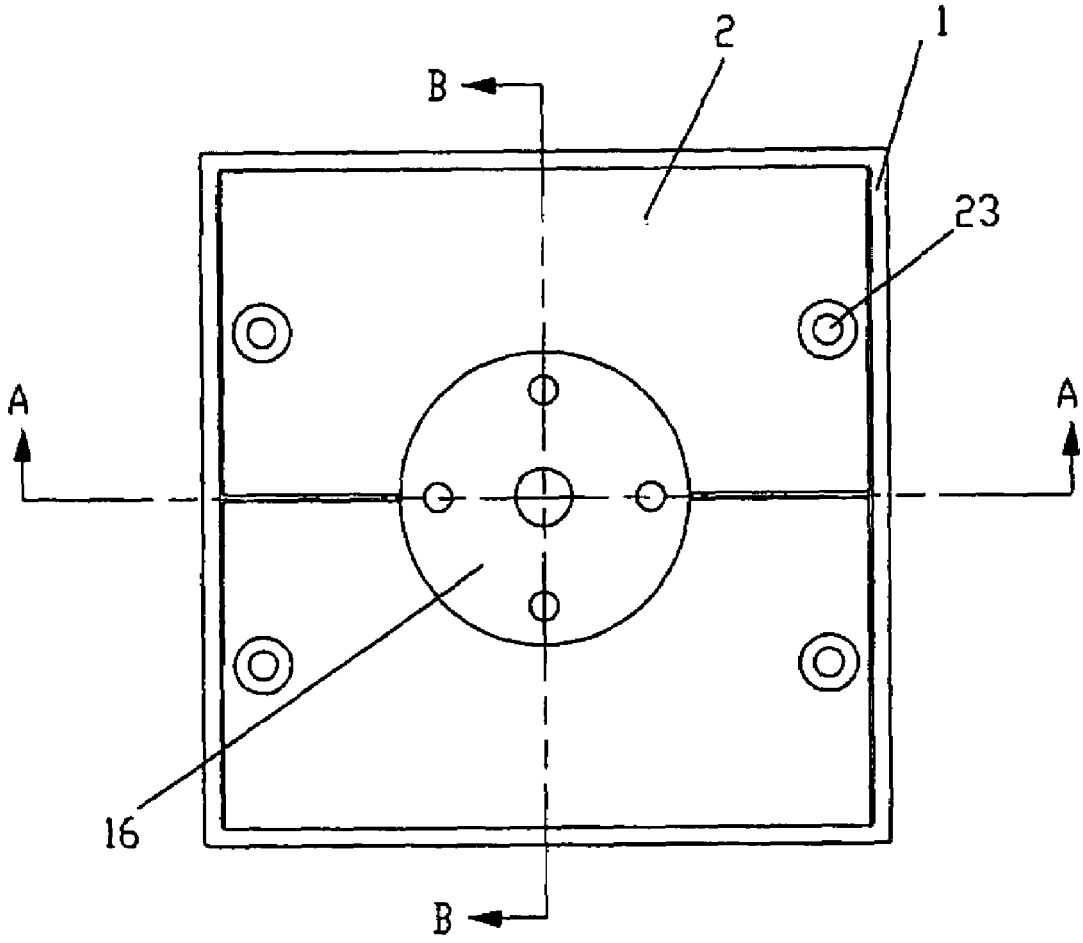
FIG. 4A shows a top view of the mounting mechanism for removable bollard according to the invention, with the cover plates mounted on the body.
Figure 4B:
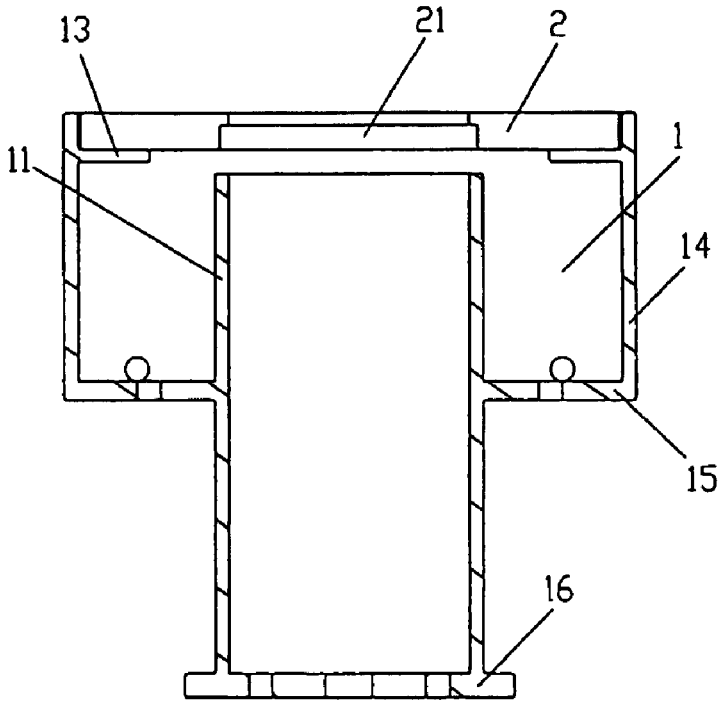
FIG. 4B shows a sectional view of the mounting mechanism for removable bollard according to the invention, with the cover plates mounted on the body in FIG. 4A taken along line A-A.
Figure 4C:
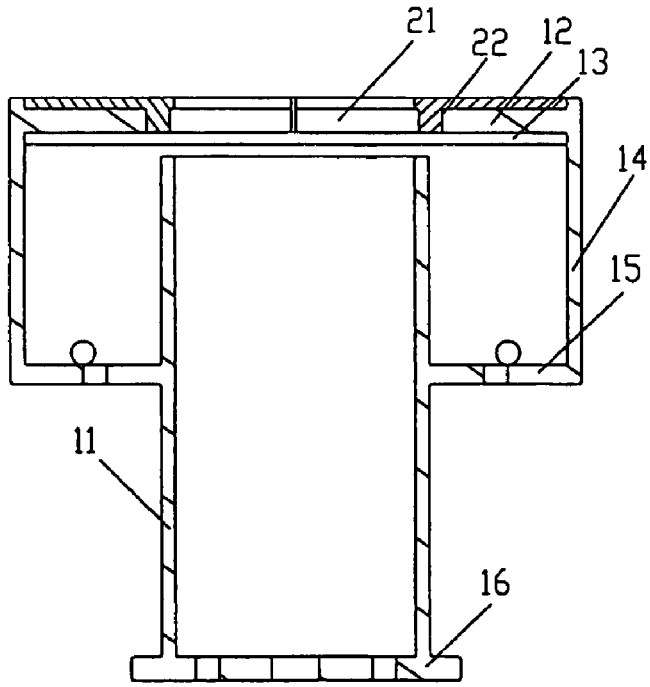
FIG. 4C shows a sectional view of the mounting mechanism for removable bollard according to the invention, with the cover plates mounted on the body in FIG. 4A taken along line B-B.

Refer now to FIGS. 4A to 4C. FIGS. 4A to 4C show the state in which the cover plates 2 are mounted on the body 1 with the notches assembled together. As shown in FIGS. 4A to 4C, the two cover plates 2 match together with the notches assembled together to cover the top open of the body 1, in which the shorter sides of the two cover plates 2 are fixed to the supporting plates 13 by screws/bolts and nuts, and the recesses 22 are fitted onto the closures 12. With the two cover plates 2 matching, the notches 21 assemble together to constitute a second through hole corresponding to the socket of the receiving part 11, thereby corresponding to the outer shape of the bollard 3. Refer to FIGS. 1B and 1C, at height of the bollard 3 corresponding to the depth of the socket, a ring 31 is formed around the bollard 3 for securely locking the bollard 3 into the socket.

The mounting process of the assembly is as follows:

Firstly, bury the body 1 of the mounting mechanism for removable bollard into the ground such that the upper plane of the body 1 is in the ground level. Secondly, insert part of the bollard 3 into the socket of the receiving part 11 with the lower surface of the ring 31 located on the top end of the receiving part 11. Thirdly, cover the cover plates 2 such that the recesses 22 of the two cover plates 2 fitted to the closures 12, and the lower surfaces of the cover plates 2 are located on the upper surface of the ring 31, and fix them to the supporting plates 13 with screws/blots and nuts. In this way, the ring 31 is firmly locked between the cover plates 2 and the top end of the receiving part 11; thereby the bollard 3 is securely mounted into the socket of the receiving part 11, i.e., in the ground.

When the bollard 3 is unnecessary, it is convenient to unlock the cover plates 2 from the supporting plates 13, thereby to easily remove the bollard from the socket.

Figure 5A:
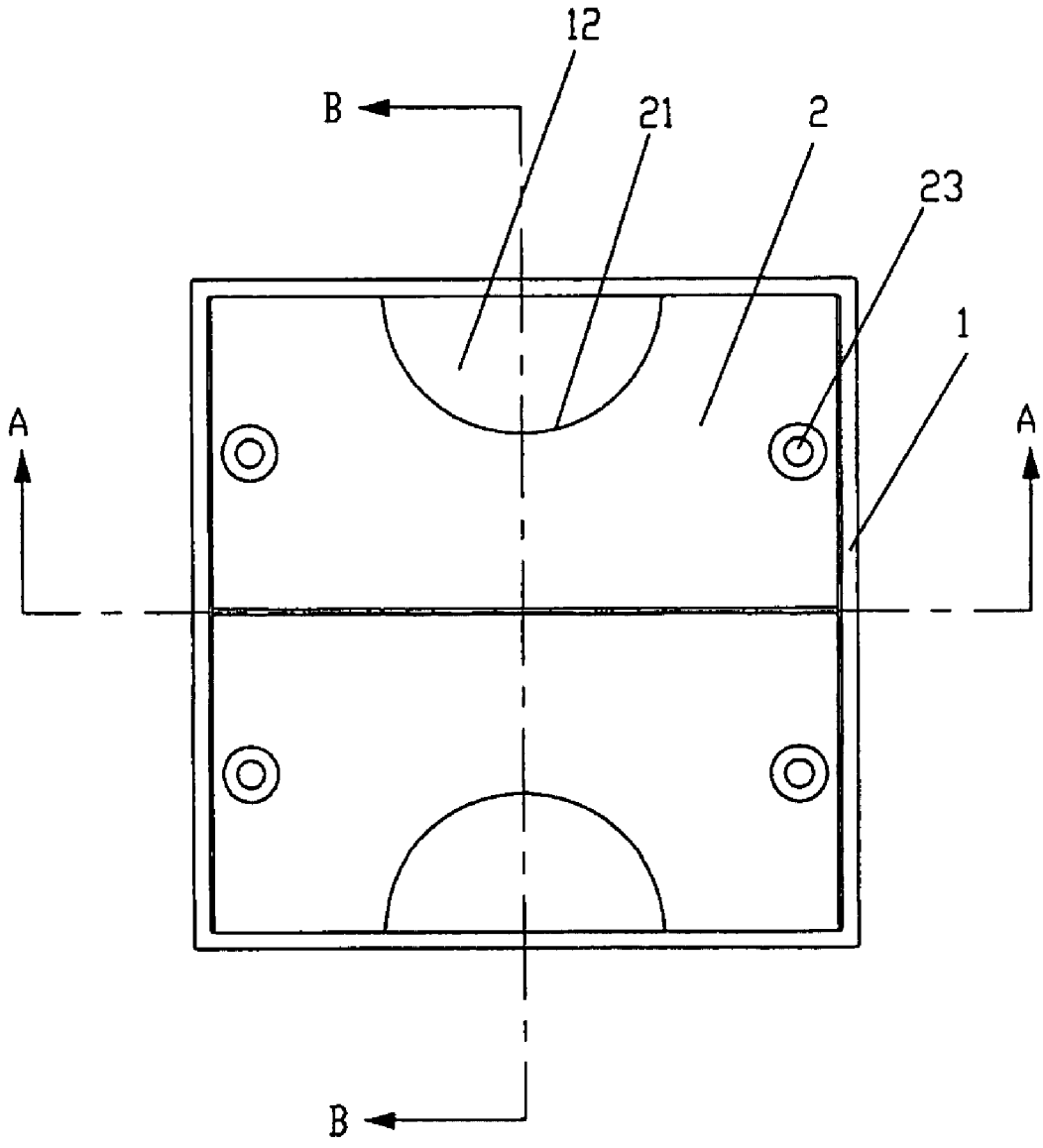
FIG. 5A shows a top view of the mounting mechanism for removable bollard according to the invention, with the rotated cover plates mounted on the body.
Figure 5B:
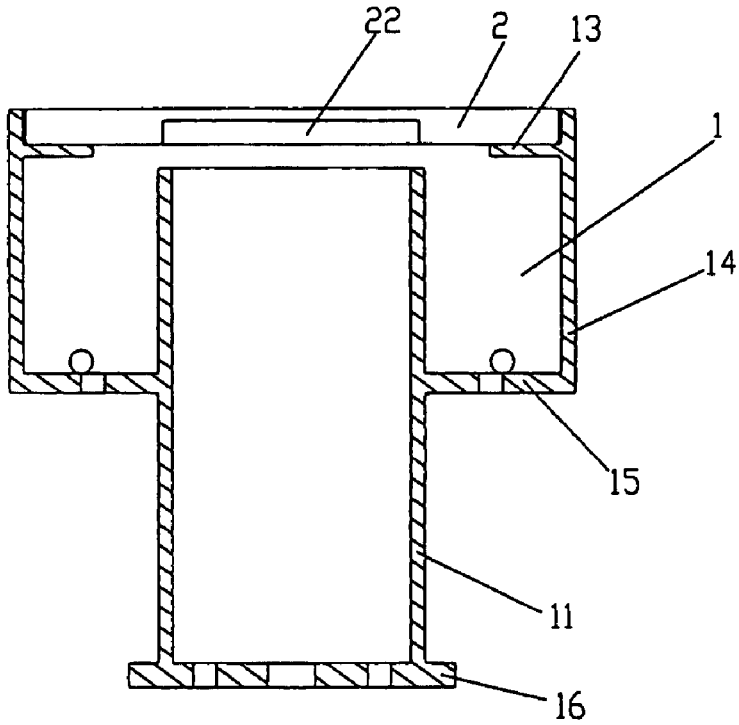
FIG. 5B shows a sectional view of the mounting mechanism for removable bollard according to the invention, with the rotated cover plates mounted on the body in FIG. 5A taken along line A-A.
Figure 5C:
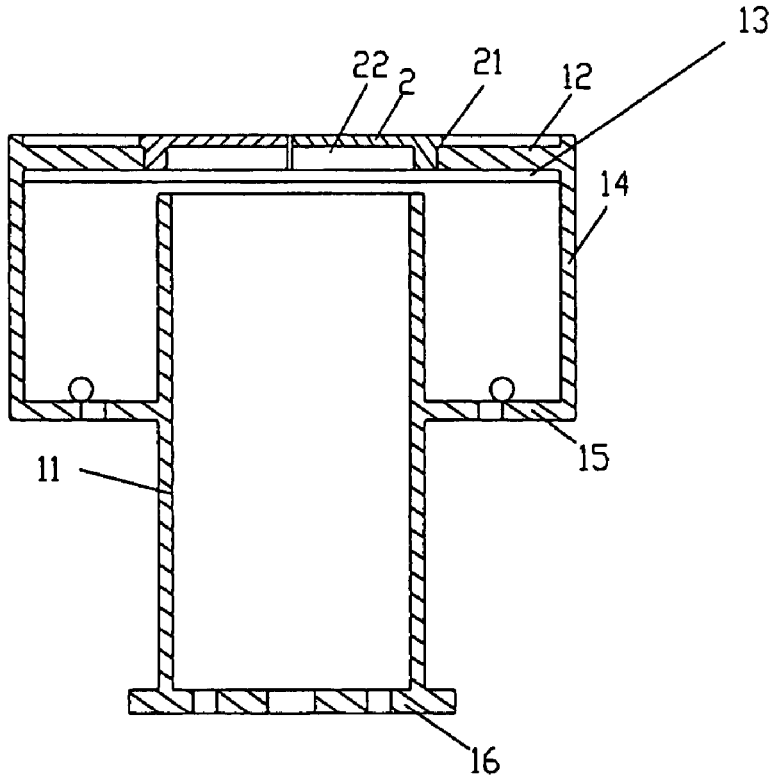
FIG. 5C shows a sectional view of the mounting mechanism for removable bollard according to the invention, with the rotated cover plates mounted on the body in FIG. 5A taken along line B-B.

Refer now to FIGS. 5A to 5C. FIGS. 5A to 5C show the state in which the rotated cover plates 2 are mounted on the body 1 after the bollard is removed. After the bollard 3 is removed from the receiving part 11, the cover plates 2 is rotated 180 degree in a horizontal plane and mounted onto the supporting plates 13 for covering the top open of the body 1, wherein the lower parts of the two notches 21 respectively fitted to the two closures 12. Thereby, the notches 21 are closed underneath by the closures 12 of the carrying part when the cover plates match together with notches separated from each other. The socket 11 is covered while only the closures 12 are slightly lower than the ground level. In this way, no any holes but two semicircular recesses appear. In order to ensure the cover plates 2 to cover the receiving part 11 completely after rotated, it is necessary to design a suitable ratio of a radius of the notches 21 to the dimension of the cover plates 2.

It is preferably that the supporting plates 13 and the closures 12 are separately arranged, it can be understood that a carrying part with a hole formed in the centre thereof may be used to replace the supporting plates 13 and the closures 12, such that the cover plates can be mounted on the carrying part and the bollard can be inserted through the hole constituted by the two notches and the hole of the carrying part, then into the socket.

It is preferably that the cover plates 2 have recesses 22 fitted to the closure 12, it can be understood, without the recesses 22, the socket still can be covered by the cover plates 2 while the recesses appeared will be slightly deeper.

It is preferably that the coupling part is in box form, it can be understood that it may be any other from that can connect the receiving part 11 to the carrying part integrally such that the position of the receiving part can be firmly fixed.

It is preferably that the receiving part 11 has a socket base 16 for preventing the bollard 3 therein from moving downwards. It can be understood that the socket base 16 is not necessary for the mounting mechanism for removable bollard.

It is preferably that the length of the portion of the bollard 3 inserted in the receiving part 11 is slightly shorter than the length of the receiving part 11.

It is preferably that the bollard 3 has a ring 31 for being locked, it can be understood that the mounting mechanism can still performed well to hold a bollard which does not have a ring, though the cover plates cannot lock the bollard in position.

It is preferably that the cross-sectional shape of the bollard 3 is symmetrical in shape, more preferably in circular shape. It can be understood that the cross-sectional shape of the bollard 3 can be square, rectangular, hexagonal, octagonal, etc. in shape, even not symmetrical in shape.

What is claimed is:

1. A mounting mechanism for removable bollard, comprising:

a body including a receiving part in which a socket is formed to receive a bollard therein;

a carrying part provided above the receiving part, wherein a first through hole is formed therein to correspond to the socket; and a coupling part connecting the carrying part with the receiving part; and at least two cover plates covering the carrying part and provided with notches corresponding to the socket, wherein the notches are arranged such that the notches constitute a second through hole corresponding to the socket when the cover plates match together with the notches assembled together, and the notches are closed by the carrying part when the cover plates rotate 180 degree in a horizontal plane with the notches separated from each other.

2. The mounting mechanism for removable bollard in accordance with claim 1, wherein a ring is arranged around the bollard at height thereof corresponding to the depth of the socket.

3. The mounting mechanism for removable bollard in accordance with claim 1, wherein the carrying part is comprised of supporting plates for supporting the cover plates and closures for closing the notches underneath, number and shape of the closures correspond to those of the notches.

4. The mounting mechanism for removable bollard in accordance with claim 3, wherein the notches are step-shaped; and the cover plates are respectively formed with recesses at the lower surfaces of a sides thereof opposite to a side thereof on which the notches are formed; and the shapes of the closures correspond to those of the lower part of the step-shaped notches and the recesses.

5. The mounting mechanism for removable bollard in accordance with claim 1, wherein the carrying part is provided with first fixing holes and the cover plates are provided with second fixing holes at positions corresponding to the first fixing holes.

6. The mounting mechanism for removable bollard in accordance with claim 1, wherein the coupling part is in box form with top opened, and the socket is located in the center of the coupling part; the distance from the position where the carrying part is perpendicularly arranged on the inner surface of side walls of the coupling part to the top of the coupling part is smaller than the distance from the top of the receiving part to the top of the coupling part and is equal to the thickness of the cover plates.

7. The mounting mechanism for removable bollard in accordance with claim 1, wherein the receiving part is provided with a socket base at a lower end thereof for closing the socket.

8. The mounting mechanism for removable bollard in accordance with claim 7, wherein a plurality of draining holes are respectively formed in the coupling part and the socket base.

* * * * *